United States Patent [19]

Denton

[11] 4,453,885

[45] Jun. 12, 1984

[54] COUNTER DEFLECTION TORQUE DEVICE

[76] Inventor: John D. Denton, Rte. 209, Box 201, Green Cove Springs, Fla. 32043

[21] Appl. No.: 391,990

[22] Filed: Jun. 25, 1982

[51] Int. Cl.[3] ..... F01D 1/18

[52] U.S. Cl. ..... 415/63; 415/80

[58] Field of Search ..... 415/63, 80, 81, 82; 416/171

[56] References Cited

U.S. PATENT DOCUMENTS

| | | | |
|---|---|---|---|
| 433,727 | 8/1890 | Goff | 415/81 |
| 1,079,177 | 11/1913 | Jones et al. | 415/63 |
| 4,087,198 | 5/1978 | Theis, Jr. | 415/82 |
| 4,278,396 | 7/1981 | Vander Horst | 415/63 |

FOREIGN PATENT DOCUMENTS

| | | | |
|---|---|---|---|
| 12217 | of 1848 | United Kingdom | 415/63 |

*Primary Examiner*—Stephen Marcus
*Assistant Examiner*—Joseph M. Pitko
*Attorney, Agent, or Firm*—Duckworth, Allen, Dyer & Pettis

[57] ABSTRACT

A counter deflection torque device is disclosed. The counter deflection torque device includes an inner hollow shaft in communication with a source of high pressure working fluid and an outer hollow shaft surrounding at least a portion of the inner hollow shaft. The outer hollow shaft is provided with seals and bearings and is connected to a hollow disk. The inner hollow shaft is provided with a plurality of openings along the portion surrounded by the outer hollow shaft. The inner hollow shaft is also placed in communication with an annular conduit disposed on the periphery of a second disk. A plurality of tangential jets are coupled to the annular conduit. The outer hollow shaft is also connected to an annular conduit on the hollow disk. A plurality of substantially tangential jets are coupled to the annular conduit in the hollow disk, and the substantially tangential jets of the hollow disk and the second disk are oriented to be opposite each other at least a portion of the counter rotation of the hollow disk and the second disk.

3 Claims, 3 Drawing Figures

COUNTER DEFLECTION TORQUE DEVICE

BACKGROUND OF THE INVENTION

This invention relates to a counter deflection torque device having tangentially disposed opposed jets supplied by concentric counter rotating conduits.

A number of devices which make use of tangential use of working fluid have been described in the prior art. For example, U.S. patent Ser. No. 36,164 describes a series of cylindrical vessels or chambers piled or placed together end to end and furnished with a tubular shaft extending axially therethrough. Within each chamber at least two curved arms are made to project from the shaft or from a hub and working fluid is expelled therethrough. Numerous toys utilizing this principle have also been described. For example, U.S. Pat. No. 1,349,226 illustrates the conduction of high pressure working fluid through a hollow conduit and through a number of tangential jets. U.S. patent Ser. No. 599,825 (Bidwell), illustrates the use of a rotary boiler cleaner which is conducted to a disk and expelled through the disk to create rotary motion. Other devices of interest include U.S. Pat. No. 3,491,069 (Meyer) and U.S. Pat. No. 1,012,409 (Monper). The Monper device illustrates a toy having two oppositely rotating disks, however no power is extracted therefrom and the method of creating counter rotation does not take advantage of counter deflecting jets of working fluid. The main disadvantage of the devices of the prior art are that none disclosed the advantage of having counter rotating tangential jets of fluid which interact in a dynamic manner to enhance performance.

SUMMARY OF THE INVENTION

The counter deflection torque device of the present device is characterized by a longitudinally disposed central shaft enclosed by a second hollow shaft. The central hollow shaft is coupled at one end to a source of high pressure working fluid and at the other end to an annular conduit disposed on a disk and having thereon a plurality of tangentially disposed jets. The outer hollow shaft is coupled through a hollow disk to a second annular conduit disposed on the hollow disk. Second annular conduit is provided with a plurality of tangential jets oppositely disposed to the plurality of tangential jets on the first annular conduit. The high pressure working fluid ejected from the respective jets provides angular momentum to the respective disks and, in addition, interacts with each other to provide dynamic advantages.

BRIEF DESCRIPTION OF THE DRAWINGS

Further details are explained below with the help of the example illustrated in the attached drawings in which.

DESCRIPTION OF THE PREFERRED EMBODIMENT

Figure 1:
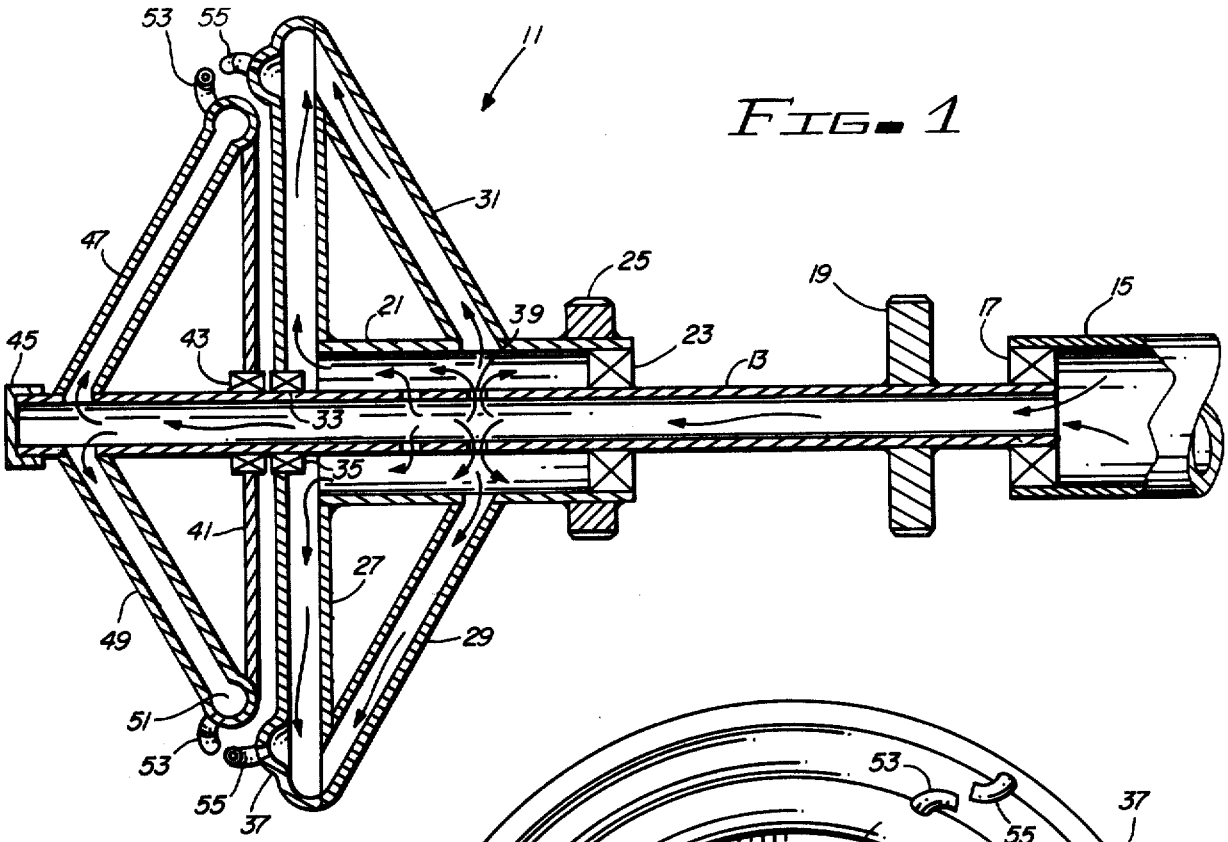
FIG. 1 is a cross section of the counter deflection torque device of the present invention.

Illustrated in FIG. 1 is the counter deflection torque device 11 of the present invention. The device 11 includes an inner hollow shaft 13 extending longitudinally through the device. The inner hollow shaft 13 is connected to a conduit 15 by means of bearing and seal 17. Conduit 15 is connected to and in communication with a source of steam, or products of combustion which are supplied through conduit 15 and into the interior of the inner hollow shaft 13 at high pressures. Also attached to the inner hollow shaft 13 is a first pinion (gear) 19. The gear 19 may be welded onto the inner hollow shaft 13.

Disposed around the inner hollow shaft 13 is an outer hollow shaft 21. The outer hollow shaft is maintained in a spaced relationship with the inner hollow shaft 13 by means of bearings and seals 23. A second pinion (gear) 25, is rigidly connected to the outer hollow shaft 21. The gear 25 is preferably welded onto the hollow shaft 21, although it could be integrally formed therewith.

The outer hollow shaft 21 is attached to a hollow disk 27. The method of attachment may be by welding. As illustrated in FIG. 1 the outer hollow shaft forms a conduit into the interior portion of the hollow disk 27. Also disposed in communication with the outer hollow shaft 21 and the hollow disk 27 are at least a pair of stabilizing conduits 29 and 31 which may be welded onto the outer hollow shaft 21 and the hollow disk 27. The stabilizing conduits are essentially hollow pipes which serve the dual purpose of allowing high pressure fluids to be transported into the hollow disk 27 and also serves to strengthen and stabilize the hollow disk 27 during operation. The hollow disk 27 is provided with an opening 33, through which the inner hollow shaft 13 is disposed. A seal and bearing 35 are disposed in the opening 33 to allow the assembly comprising the outer hollow shaft 21, the hollow disk 27 and the stabilizing conduit 29 to rotate freely about the inner hollow shaft 13. Integrally formed with the hollow disk 27 is an annular conduit 37, also illustrated in FIG. 2.

As illustrated in FIG. 1, the inner hollow shaft 13 is provided with a plurality of radial openings 39 along the portion of the inner hollow shaft 13 that is surrounded by the outer hollow shaft 21. The effect of the radial openings 39 is to allow the high pressure fluid transported by conduit 15 to flow substantially as shown by the arrows in FIG. 1. Thus, a substantial portion of the high pressure working fluid is diverted into the assembly comprising the outer hollow shaft 21 the hollow disk 27 and the stabilizing conduits 29 and 31.

The inner hollow shaft 13 extends through the opening 33 on the hollow disk 27 and through a second disk 41. The second disk 41 is supported on the inner hollow shaft by means of bearings 43. Although the second disk 41 is shown as a solid thin disk, it may also be constructed as a hollow disk substantially similar to hollow disk 27. The inner hollow shaft 13 extends longitudinally until it reaches a cap end 45. At least a pair of radial conduits 47 and 49 are connected to an in communication of the interior of the inner hollow shaft 13 and extend into the direction of the second disk 41 until they join a second annular conduit 51.

Figure 2:
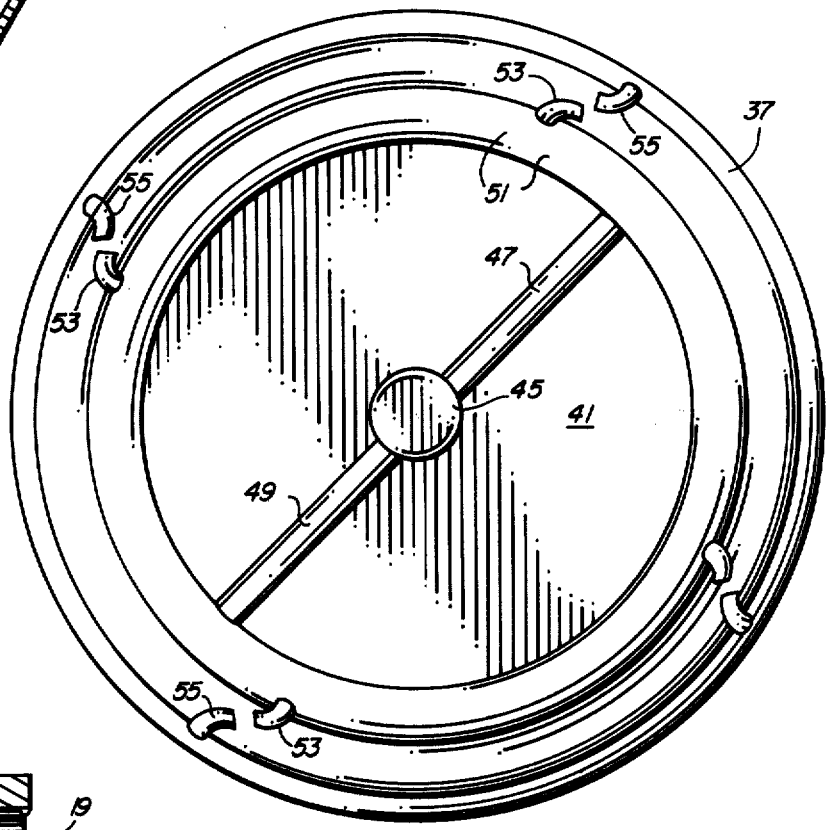
FIG. 2 is a front view of the device.

As illustrated in FIG. 1, the second annular conduit 51 and the annular conduit 37 are disposed in close proximity to each other. Disposed on the second annular conduit 51 are a plurality of tangential jets 53 which are illustrated in FIG. 2 as oriented in a substantially clockwise direction. Disposed on an annular conduit 37 are a plurality of tangential jets 55 which are illustrated in FIG. 2 as directed in a substantially counterclockwise direction. It should be stressed that the orientation of tangential jets 53 and tangential jets 55 are not critical to the operation of the device. What is important is that tangential jets 53 be opposed in direction to tangential jets 55. It is also important to place the exit orifices of tangential jets 53 in close proximity to the circular path traversed by the exit orifice of tangential jets 55.

The operation of the device can be best understood by reference to FIG. 2. When the high pressure working fluid exits through tangential jet 53 and tangential jets 55 they set up a counter rotating motion in hollow disk 27 and second disk 41. In addition, as the jets 53 and jets 55 come into close proximity to one another the exiting fluid is dynamically deflected yielding substantial dynamic advantages for the device.

Figure 3:
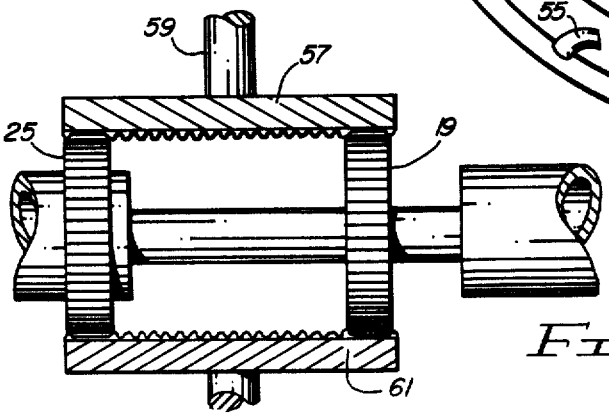
FIG. 3 is a top view of the gear box of the present invention.

Torque power for this device can be extracted by the mechanism illustrated in FIG. 3. Shown in FIG. 3 is a top view of the gear box of the device 11, illustrating pinion 19 and pinion 25. Because pinion 19 is connected to the inner hollow shaft 13 which is connected to the second disk 41, pinion 19 rotates in a counterclockwise direction (in the embodiment of FIG. 2). Conversely, pinion 25 is connected to outer hollow shaft 21 which is in turn connected to hollow disk 27 which rotates in a clockwise direction. Therefore, the pinion 25 will also rotate in a clockwise direction. Power can be extracted from the counter rotating wheel by placing at least one bevel gear 57 in contact with pinions 19 and 25. Bevel gear 57 can be attached to a shaft 59 which can be used to extract power. A second bevel gear 61 can also be used and attached to a shaft 63 to also extract power.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

I claim:

1. A counter rotating engine comprising:

(a) a first rotatable annular conduit;

(b) a second rotatable annular conduit disposed adjacent to said first rotatable annular conduit;

(c) a first plurality of substantially tangential jets disposed on and in communication with the interior of said first rotatable annular conduit said first plurality of jets defining a first circular path when said first rotatable annular conduit rotates;

(d) a second plurality of substantially tangential jets disposed on and in communication with said second rotatable annular conduit said second plurality of jets defining a second circular path when the second annular conduit rotates, and said second plurality of jets being disposed relative to said first plurality of jets so that the first and second circular paths coincide;

(e) a first hollow rotatable shaft adapted to conduit high pressure working fluid, said shaft having a plurality of radial openings along a predetermined longitudinal segment;

(f) a second hollow rotatable shaft disposed substantially concentric with and surrounding the predetermined longitudinal segment of the first hollow shaft;

(g) first means for coupling said second hollow shaft to said first annular conduit; and (h) second means for coupling said first hollow shaft to said second annular conduit;

(i) a hollow disk attached to one end of said second hollow shaft said hollow disk disposed in communication with said first annular conduit; and (j) a plurality of hollow stabilizing conduits each being attached at one end to the second hollow shaft and at the other end to the hollow disk.

2. The counter rotating enging of claim 1 wherein said first means for coupling comprises:

a plurality of pipes, each one having an end attached to and in communication with the interior portion of the first hollow shaft and the other end attached to and in communication with the second annular conduit.

3. The counter rotating engine of claim 2 further comprising:

a first pinion attached to said first hollow shaft;

a second pinion attached to said second hollow shaft;

a bevel gear coupled to said first and second pinion; and a shaft coupled to said bevel gear.

* * * * *